US009506437B2

(12) United States Patent
Pilgram

(10) Patent No.: US 9,506,437 B2
(45) Date of Patent: Nov. 29, 2016

(54) INJECTION VALVE

(71) Applicant: Robert Bosch GmbH, Stuttgart (DE)

(72) Inventor: Guido Pilgram, Gundelsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/443,239

(22) PCT Filed: Oct. 1, 2013

(86) PCT No.: PCT/EP2013/070405

§ 371 (c)(1),
(2) Date: May 15, 2015

(87) PCT Pub. No.: WO2014/082774

PCT Pub. Date: Jun. 5, 2014

(65) Prior Publication Data

US 2015/0300304 A1 Oct. 22, 2015

(30) Foreign Application Priority Data

Nov. 28, 2012 (DE) ..... 10 2012 221 713

(51) Int. Cl.

| | |
|---|---|
| ***F02M 51/00*** | (2006.01) |
| ***F02M 61/04*** | (2006.01) |
| ***B05B 1/28*** | (2006.01) |
| ***B05B 1/02*** | (2006.01) |
| ***F02M 51/06*** | (2006.01) |
| ***F02M 61/18*** | (2006.01) |
| ***F02M 61/16*** | (2006.01) |

(52) U.S. Cl.

CPC ..... *F02M 61/04* (2013.01); *B05B 1/02* (2013.01); *B05B 1/28* (2013.01); *F02M 51/061* (2013.01);

(Continued)

(58) Field of Classification Search

CPC ..... B05B 1/28; B05B 1/02; F02M 61/1806; F02M 51/061; F02M 61/1853; F02M 61/04; F02M 61/1833; F02M 61/1826; F02M 61/168

USPC ..... 239/499, 500, 533.11, 533.12, 585.1, 239/585.4, 596, 601

See application file for complete search history.

(56) References Cited

U.S. PATENT DOCUMENTS

| | | | | |
|---|---|---|---|---|
| 5,881,958 | A | 3/1999 | Asakawa et al. | |
| 7,234,654 | B2 * | 6/2007 | Holzgrefe | F02M 61/1833 239/499 |

(Continued)

FOREIGN PATENT DOCUMENTS

| | | |
|---|---|---|
| DE | 196 36 396 | 3/1998 |
| DE | 199 37 961 | 2/2001 |

(Continued)

OTHER PUBLICATIONS

International Search Report for PCT/EP2013/070405, dated Nov. 27, 2013.

*Primary Examiner* — Steven J Ganey

(74) *Attorney, Agent, or Firm* — Norton Rose Fulbright US LLP; Gerard Messina

(57) ABSTRACT

A fuel injection valve includes: a magnetic coil; an armature; and a valve needle connected to the armature for actuating a valve closing body which forms, together with a valve seat surface, a seal seat. Formed downstream from the valve seat surface is a spray opening that has, at the transition from a first to a second spray opening segment, a tear-off edge such that the complete opening angle of the spray opening at the tear-off edge is greater than 270° over the entire circumferential tear-off edge, so that, going out from the tear-off edge, on the floor of the second spray opening segment of the spray opening, there extends a circumferential floor region that is recessed behind the transition plane in which the tear-off edge is situated.

5 Claims, 3 Drawing Sheets

(52) U.S. Cl.
CPC ..... *F02M 61/168* (2013.01); *F02M 61/1806* (2013.01); *F02M 61/1826* (2013.01); *F02M 61/1833* (2013.01); *F02M 61/1853* (2013.01)

(56) References Cited

U.S. PATENT DOCUMENTS 8,191,800 B2 * 6/2012 Kitagawa ..... F02M 51/061 239/533.12
8,313,048 B2 * 11/2012 Krause ..... F02M 51/0671 239/533.12
2007/0012805 A1 * 1/2007 Maier ..... F02M 51/0671 239/601

FOREIGN PATENT DOCUMENTS

| | | |
|---|---|---|
| DE | 10 2006 051327 | 5/2008 |
| EP | 0 918 157 | 5/1999 |
| FR | 415 512 | 9/1910 |
| WO | WO 2004/109094 | 12/2004 |

* cited by examiner

INJECTION VALVE

BACKGROUND OF THE INVENTION

1. Field of the Invention

The present invention relates to a fuel injection valve having spray openings downstream from a valve seat surface.

2. Description of the Related Art

From published German patent application document DE 196 36 396 A1, a fuel injection valve is known that has a perforated plate downstream from its valve seat surface, with which valve seat surface a valve closing element cooperates to open and close the valve. This pot-shaped perforated plate, formed from a sheet, has a large number of spray openings through which the fuel is emitted, for example into an intake manifold of an internal combustion engine, in the direction of an inlet valve. These spray openings are made in the perforated plate by stamping, erosion, or laser boring. The spray openings have a constant circular or elliptical cross-section continuously along their axial length.

From published German patent application document DE 199 37 961 A1, a fuel injection valve is known that has a fuel inlet, an excitable actuation device by which a valve closing element can be moved, a valve seat fixed on a valve seating element, with which valve seat the valve closing element cooperates to open and close the valve, and at least one outlet opening provided downstream from the valve seat as fuel outlet. The at least one outlet opening has, at its spray end, an outlet region that deviates in its shape and/or size and/or contour from the rest of the realization of the outlet opening, the outlet region of the outlet opening having a convex or concave curvature, running conically to one another or from one another, in a realization with multiple steps, or the like.

BRIEF SUMMARY OF THE INVENTION

The injection valve according to the present invention has the advantage that, in a low-cost fashion per spray opening a spray can be produced that supplies very good atomization quality with regard to its lamellar decomposition; in particular, a defined tear-off in the flow is achieved already within the spray opening, which advantageously effectively reduces the tendency toward coking in the spray opening.

The liquid to be sprayed is torn off, by the tear-off edge fashioned at the transition of the at least two opening segments of the spray opening, in a more defined and more effective manner than is the case in known stepped spray openings.

It is advantageous to make the base region, which runs radially outward in recessed fashion going out from the tear-off edge, of the second spray opening segment with an oblique inclination, with a concave curvature, or in the shape of a roof.

It is advantageous to produce the contour of the spray opening using USP laser drilling. With this method, such contours can be produced at low cost and with high precision.

DETAILED DESCRIPTION OF THE INVENTION

Figure 1:
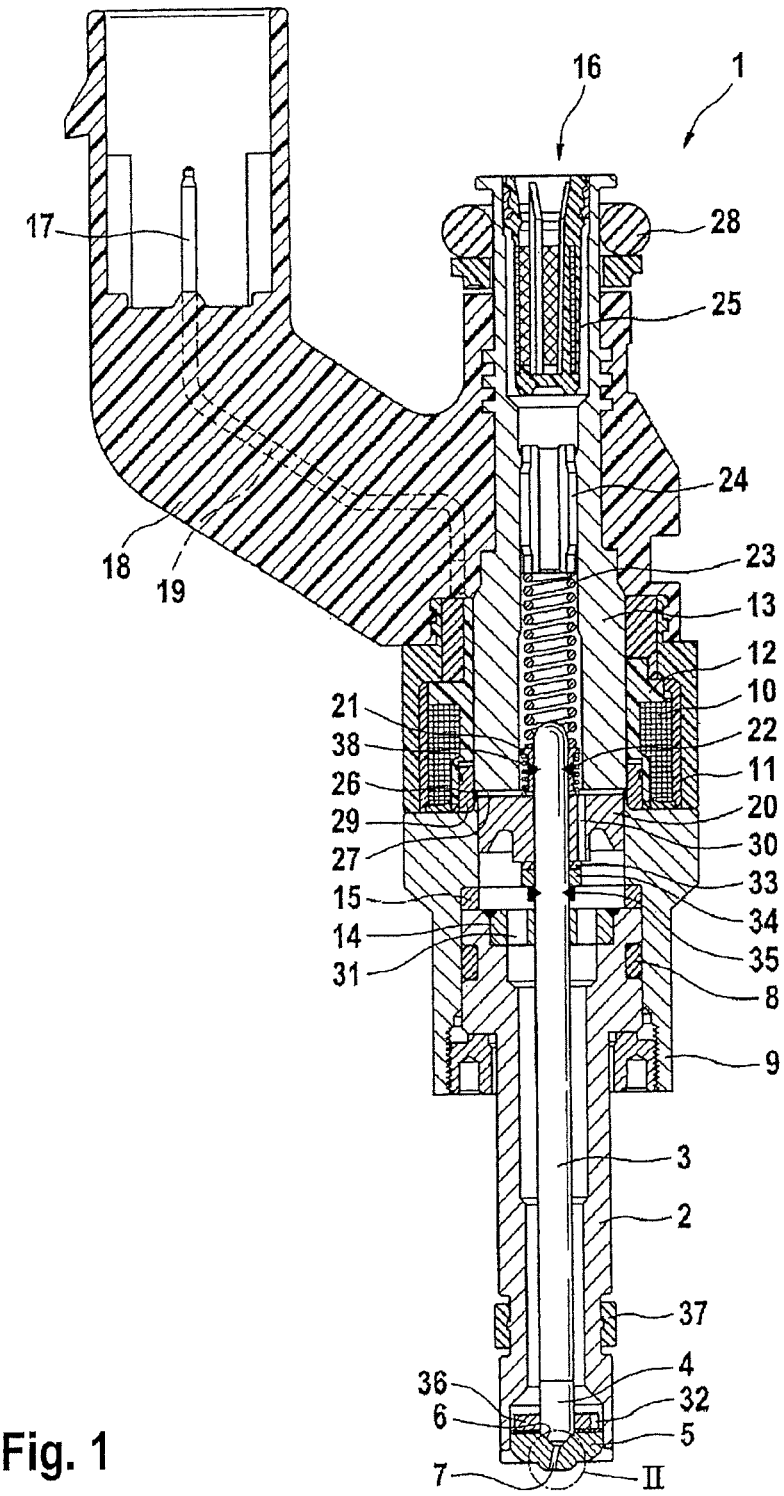
FIG. 1 shows an axial section through a fuel injection valve known from the existing art.
Figure 2:
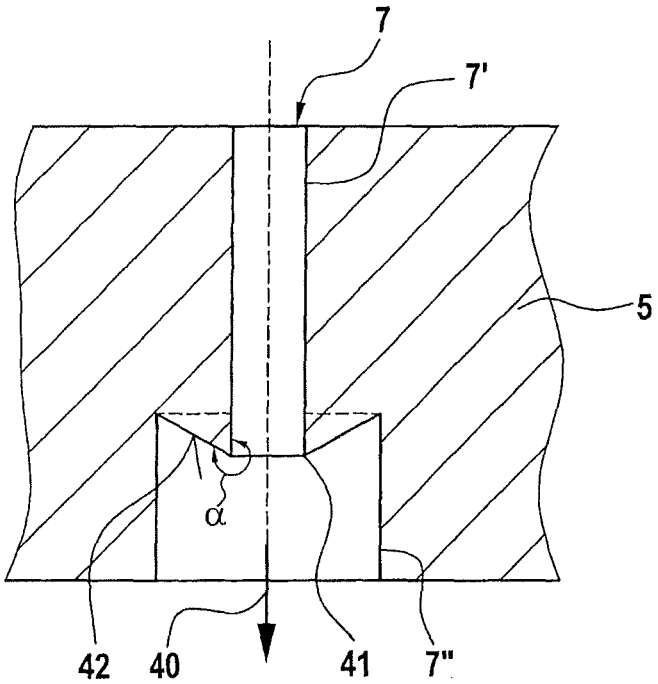
FIG. 2 shows an enlarged detail of the fuel injection valve of FIG. 1, in region II in FIG. 1, having a first spray opening, realized according to the present invention, of an injection valve.
Figure 3:
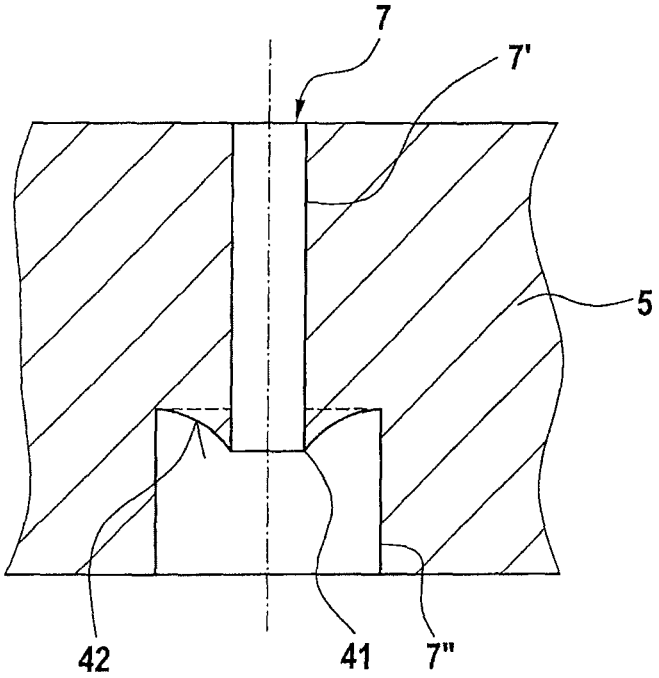
FIG. 3 shows a second embodiment of a spray opening realized according to the present invention.
Figure 4:
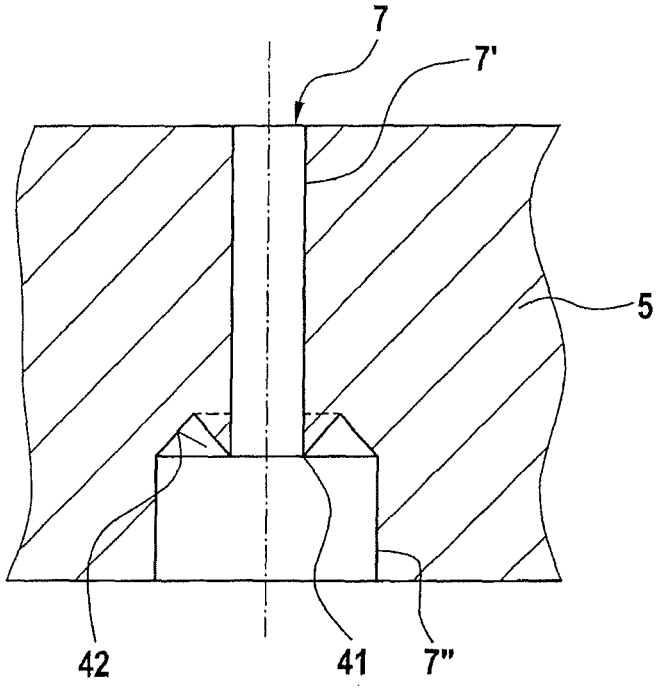
FIG. 4 shows a third embodiment of a spray opening realized according to the present invention.

Before describing in more detail, on the basis of FIGS. 2 through 4, exemplary embodiments of an injection valve according to the present invention, for the better understanding of the present invention a known fuel injection valve is briefly explained with regard to its essential components, on the basis of FIG. 1.

Fuel injection valve 1 shown in FIG. 1 is realized in the form of a fuel injection valve 1 for fuel injection systems of mixture-compressing externally ignited internal combustion engines. Fuel injection valve 1 is suitable in particular for the direct injection of fuel into a combustion chamber (not shown) of an internal combustion engine. However, it is expressly to be noted that the realization according to the present invention of a spray hole is described only as an example on the basis of such a fuel injection valve 1, but the present invention can however be realized in fuel injection valves for intake manifold injection, fuel injection valves for self-igniting internal combustion engines, or injection valves for the introduction of aqueous urea solutions (e.g. AdBlue™) into the exhaust train of internal combustion engines, or the like.

Fuel injection valve 1 is made up of a nozzle body 2 in which a valve needle 3 is situated. Valve needle 3 is operatively connected to a valve closing body 4 that works together with a valve seat surface 6, situated on a valve seating body 5, to form a seal seat. In the exemplary embodiment, fuel injection valve 1 is an inward-opening fuel injection valve 1 that has at least one spray opening 7. However, fuel injection valve 1 is realized for example as a multi-hole injection valve, and therefore has between two and twenty spray openings 7. Nozzle body 2 is sealed by a seal 8 against an outer pole 9 of a magnetic coil 10. Magnetic coil 10 is encapsulated in a coil housing 11, and is wound on a coil bearer 12 that lies against an inner pole 13 of magnetic coil 10. Inner pole 13 and outer pole 9 are separated from one another by a narrowing 26, and are connected to one another by a non-ferromagnetic connecting component 29. Magnetic coil 10 is excited, via a line 19, by an electrical current that can be supplied via an electrical plug contact 17. Plug contact 17 is surrounded by a plastic cladding 18 that can be injected on inner pole 13.

Instead of an electromagnetic actuator, a piezoelectric, magnetostrictive, or other drive may be used to actuate valve closing body 4.

Valve needle 3 is guided in a valve needle guide 14 realized in the shape of a disc. A setting disc 15 paired therewith is used to set the stroke. Upstream from setting disc 15 there is an armature 20. This armature is connected with a non-positive fit via a first flange 21 to valve needle 3, which is connected to first flange 21 by a weld seam 22. On first flange 21 there is supported a reset spring 23 that, in the present embodiment of fuel injection valve 1, is pre-tensioned by a setting sleeve 24.

Fuel ducts 30, 31, and 32 run in upper valve needle guide 14, in armature 20, and on a lower guide element 36. The fuel is supplied via a central fuel supply line 16 and is filtered by a filter element 25. Fuel injection valve 1 is sealed by a seal 28 against a fuel distribution line (not further shown) and is sealed by a further seal 37 against a cylinder head (not further shown).

At the spray side of armature 20, there is situated an annular damping element 33 made of an elastomer material. This element lies against a second flange 34 that is connected with a non-positive fit to valve needle 3 via a weld seam 35.

Between first flange 21 and armature 20 there is situated a pre-stroke spring 38 that holds armature 20 in a seated position on second flange 34 in the idle state of fuel injection valve 1. The spring constant of pre-stroke spring 38 is significantly smaller than the spring constant of reset spring 23.

In the idle state of fuel injection valve 1, armature 20 is loaded by reset spring 23 and by pre-stroke spring 38 against its stroke direction in such a way that valve closing body 4 is held on valve seat surface 6 with a sealing seat. When magnetic coil 10 is excited, this coil builds up a magnetic field that first moves armature 20 in the stroke direction, against the spring force of pre-stroke spring 38, a free path for the armature being provided by the spacing between first flange 21 and armature 20. After traversing the free armature path, armature 20 also carries first flange 21, which is welded to valve needle 3, along with it in the stroke direction, against the spring force of reset spring 23. Here, armature 20 traverses an overall stroke that corresponds to the height of working gap 27 between armature 20 and inner pole 13. Valve closing body 4, which is connected to valve needle 3, is lifted off from valve seat surface 6, and the fuel guided via fuel ducts 30 through 32 is sprayed through spray opening 7.

If the coil current is shut off, then, after the magnetic field has been sufficiently dismantled, armature 20 falls away from inner pole 13 due to the pressure of reset spring 23, causing first flange 21, which is connected to valve needle 3, to move opposite the stroke direction. In this way, valve needle 3 is moved in the same direction, causing valve closing body 4 to become seated on valve seat surface 6, and closing fuel injection valve 1. Pre-stroke spring 38 then in turn loads armature 20 in such a way that the armature does not bounce back from second flange 34, but rather returns to the rest state without bouncing upon impact.

FIG. 2 shows, in a detailed axial sectional representation, the detail designated II in FIG. 1 of a first exemplary embodiment according to the present invention of spray opening 7. According to the present invention, spray opening 7 is distinguished in that it is formed from two successive spray opening segments 7', 7", the first spray opening segment 7', when seen in the direction of flow according to arrow 40, having a smaller opening width, and in particular, given a cylindrical realization of spray opening segments 7', 7", having a smaller diameter, than the opening width or the diameter of second spray opening segment 7".

In fuel injection valves 1 for the direct injection of fuel into the combustion chamber of an internal combustion engine, there is a significant risk of buildup of a coating on the downstream components, such as spray hole disks and valve seat bodies. In particular, spray openings 7 are susceptible to coking of the open cross-section, so that, disadvantageously, quantities smaller than the desired spray quantities may result. It is correspondingly desirable to deliberately set the temperature in the region of the downstream end of fuel injection valve 1 surrounding valve seat body 5. Moreover, it should be ensured as well as possible that a constant flow quantity can be sprayed via spray openings 7 over the entire lifespan of fuel injection valve 1. It has been found that in particular given stepped spray openings 7 having an enlarged opening width in the downstream direction, the tendency to form a coating, to coking, and thus the risk of clogging of the open cross-section of spray openings 7, is significantly reduced.

It is therefore particularly advantageous to specifically shape stepped spray openings 7. At the transition of the at least two spray opening segments 7', 7" of spray opening 7, there is fashioned a tear-off edge 41 that is distinguished in that is formed circumferentially by the material of the valve seat body 5, of the nozzle body, or of a spray hole disc with an angle of <90° in this region. In other words, this means that the complete opening angle $\alpha$ of spray opening 7 at tear-off edge 41 is greater than 270° over the entire circumferential tear-off edge 41, thereby achieving a very defined and effective tear-off of the fluid to be sprayed. Going out from tear-off edge 41, there necessarily extends, on the floor of second spray opening segment 7" of spray opening 7, an annular circumferential floor region 42 that is situated in at least partly recessed fashion behind the transition plane in which tear-off edge 41 is situated.

FIG. 2 shows a specific embodiment of spray opening 7 in which, going out from tear-off edge 41, floor region 42, running radially outward in recessed fashion, has an oblique inclination and runs in planar fashion, so that the most deeply recessed annular region is situated in the outer wall region of second spray opening segment 7" of spray opening 7.

FIG. 3 shows a second exemplary embodiment of a spray opening 7 in a valve seat body 5, in a detail view comparable to FIG. 2. The single significant difference from the specific embodiment shown in FIG. 2 is that here, going out from tear-off edge 41, floor region 42, running radially outward in recessed fashion, has a concave curvature, while here as well for example the most deeply recessed annular region is situated in the outer wall region of second spray opening segment 7" of spray opening 7.

In a third embodiment of a spray opening 7 in a valve seat body 5, also shown, in FIG. 4, in a detail representation comparable to that of FIG. 2, floor region 42 is fashioned in the shape of a roof. Going out from tear-off edge 41, floor region 42, running radially outward in recessed fashion, has an oblique inclination up to a deepest point that does not run flush with outer wall region of second spray opening segment 7" of spray opening 7. Rather, from this deepest point a further planar and obliquely inclined floor region 42 runs in the other direction of inclination, up to the outer wall region of second spray opening segment 7" of spray opening 7. The transition from obliquely inclined floor region 42 to the outer wall region of second spray opening segment 7" of spray opening 7 can here be situated in the plane of tear-off edge 41, as shown in FIG. 4; however, this is not a necessary condition.

Ideally, the contours according to the present invention are produced at low cost using USP (Ultra Short Pulse) laser drilling.

The present invention is not limited to the depicted exemplary embodiments, and can be used for example for differently configured spray openings 7, and for any desired designs of inward-opening multi-hole fuel injection valves 1.

What is claimed is:

1. An injection valve for a fuel injection system of an internal combustion engine, comprising:

an actuator;

a movable valve component;

a valve closing body which forms, together with a valve seat surface, a seal seat; and at least one spray opening formed downstream from the valve seat surface, the at least one spray opening having at least one upstream first spray opening segment having a first opening width, and having a downstream second spray opening segment having a second opening width greater than the first opening width, wherein at a transition from the first to the second spray opening segment, a tear-off edge is formed in such a way that a complete opening angle of the at least one spray opening at the tear-off edge is greater than 270° over an entire circumferential tear-off edge so that, going out from the tear-off edge on a floor of the second spray opening segment of the at least one spray opening, a recessed circumferential floor region extends behind a transition plan in which the tear-off edge is situated;

wherein going out from the tear-off edge, the floor region which extends radially outward in recessed fashion extends with an oblique inclination up to a deepest point that does not run flush with an outer wall region of the second spray opening segment of the at least one spray opening.

2. The injection valve as recited in claim 1, wherein going out from the deepest point, a further planar and obliquely inclined floor region extends in the other direction of inclination, up to the outer wall region of the second spray opening segment of the at least one spray opening.

3. The injection valve as recited in claim 1, wherein a contour of the at least one spray opening is produced by laser drilling.

4. The injection valve as recited in claim 1, wherein the valve component that has the at least one spray opening is the valve seat body.

5. The injection valve as recited in claim 4, wherein between two and twenty spray openings are provided in the corresponding valve component.

* * * * *